US005821044A

United States Patent [19]

Bergthaller et al.

[11] Patent Number: 5,821,044

[45] Date of Patent: Oct. 13, 1998

[54] PHOTOGRAPHIC SILVER HALIDE EMULSIONS

[75] Inventors: Peter Bergthaller, Bergisch Gladbach; Jörg Siegel, Leverkusen; Hans-Ulrich Borst, Elsdorf; Michael Missfeldt, Leichlingen, all of Germany

[73] Assignee: Agfa-Gevaert Aktiengesellschaft, Germany

[21] Appl. No.: 896,217

[22] Filed: Jul. 17, 1997

[30] Foreign Application Priority Data

Jul. 25, 1996 [DE] Germany ..... 196 29 981.0

[51] Int. Cl.[6] ..... G03C 1/28; G03C 1/09

[52] U.S. Cl. ..... 430/573; 430/604; 430/605

[58] Field of Search ..... 430/604, 605, 430/573

[56] References Cited

U.S. PATENT DOCUMENTS

| | | | |
|---|---|---|---|
| 4,607,006 | 8/1986 | Hirano et al. | 430/572 |
| 5,457,022 | 10/1995 | Hioki et al. | 430/612 |
| 5,578,440 | 11/1996 | Hioki et al. | 430/581 |
| 5,667,958 | 9/1997 | Hioki et al. | 430/604 |

*Primary Examiner*—Mark F. Huff
*Attorney, Agent, or Firm*—Connolly & Hutz

[57] ABSTRACT

A spectrally sensitised photographic silver halide emulsion which is super-sensitised with an aromatic complex having a central transition metal atom which is present in a valence state which is not the highest possible for the metal concerned and which complex contains at least one non-aromatic complex ligand, is distinguished by increased sensitivity.

8 Claims, No Drawings

PHOTOGRAPHIC SILVER HALIDE EMULSIONS

This invention relates to spectrally sensitised photographic silver halide emulsions having increased colour sensitivity.

The invention moreover relates to a colour photographic recording or print material which exhibits increased sensitivity by virtue of at least one of the spectrally sensitised silver halide emulsions used being supersensitised.

It is known that spectrally sensitised emulsions may be supersensitised by applying compounds, in particular additional dyes, onto the surface of the silver halide crystals in addition to the sensitisers, which compounds are capable of scavenging holes and suppressing hole-induced desensitisation. While many defect electron scavengers do indeed have a supersensitising action, they bring about an unwanted increase in fog. A typical such compound is ascorbic acid.

Further suitable compounds may be found in U.S. Pat. No. 4,011,083, 3,695,888, 3,809,561 and U.S. Pat. No. 2,945,762, 5,457,022 describes supersensitisation by metallocenes. These are dinuclear aromatic transition metal complexes of cyclopentadiene and the derivatives thereof with iron, titanium, vanadium, chromium, cobalt, nickel, ruthenium, osmium or palladium. Particular emphasis is placed on derivatives of ferrocene, a stable, dinuclear iron (II) cyclopentadiene complex.

It has now surprisingly been found that aromatic complexes having a central transition metal atom which is present in a valence state which is not the highest possible for the metal concerned and at least one non-aromatic complex ligand in combination with spectrally sensitising dyes are capable of supersensitisation without bringing about an increase in fog and storage fog.

Suitable transition metals are vanadium, chromium, manganese, iron, cobalt, nickel, molybdenum, rhenium, ruthenium, rhodium, tungsten, osmium and iridium.

The bond state of the transition metal central atom in the complexes according to the invention preferably corresponds to a valence state which is at least one unit lower than in the lower-valent inorganic salts of the transition metal concerned.

With regard to the electron balance of the formula, the complexes according to the invention fulfil the so-called 18 electron rule established for transition metal complexes by Mitchell and Parish in *Journal of Chemical Education* 46, 811–814 (1969). According to this rule, all complexes according to the invention are in a reducing state.

Aromatic structures which may be considered are, for example, those having 6 or 10 π electrons, preferably the cyclopentadienyl anion, the indenyl anion, pyrrole, thiophene and benzene as well as the substituted derivatives thereof, in particular the cyclopentadienyl anion, which may optionally be substituted by alkyl, aryl, carboxyl and carboxyl derivatives.

Suitable non-aromatic complex ligands are, for example, CO, R—N═C and NO, wherein CO is preferred and R denotes alkyl or aryl.

The complexes according to the invention are described below as π complexes. Particularly valuable π complexes are those of formally zero- to monovalent iron, of zero- or monovalent manganese, of zero-valent chromium. Particularly preferred complexes are cyclopentadienylmanganese carbonyls and cyclopentadienyliron carbonyls which contain no electronegative ligands, in particular no halogen ligands, but also arylchromium carbonyls, arylmolybdenum carbonyls and aryl-tungsten carbonyls.

Particularly preferred complexes are cyclopentadienylmanganese tricarbonyl and the derivatives of cyclopentadienylmanganese tricarbonyl substituted on the cyclopentadiene ring, in particular methylcyclopentadienylmanganese (II) tricarbonyl and arylcyclopentadienylmanganese(II) tricarbonyls. The compounds are usually termed cymantrenes in the chemical literature.

Further preferred complexes are cyclopentadienylmanganese dicarbonyls or cyclopentadienylrhenium dicarbonyls having an additional ligand on the metal atom. Ligands which may in particular be considered are phosphanes, phosphorus tri-fluoride, isocyanides, nitrites, ylides etc., but also carbene residues, which in particular have a heteroatom on the immediately attached C atom. The metal atom may also be attached to an additional ligand by a double or triple bond. Examples of cymantrenes and other suitable complexes are listed below, wherein the five-membered carbocycle denotes the cyclopentadienyl anion.

1

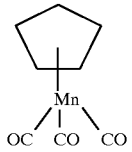

2

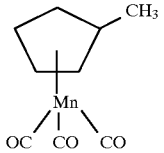

3

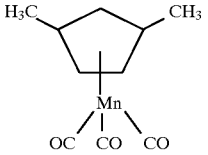

4

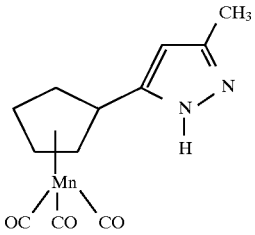

5

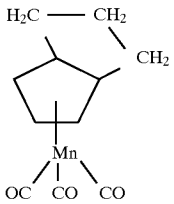

6

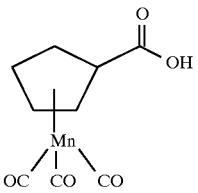

-continued
7
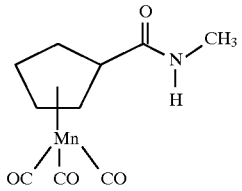
8
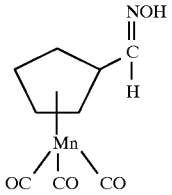
9
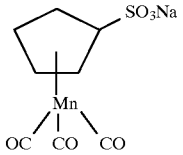
10
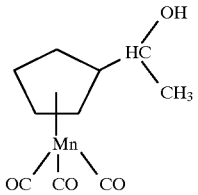
11
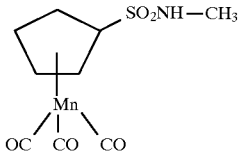
12
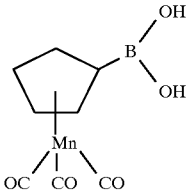
13
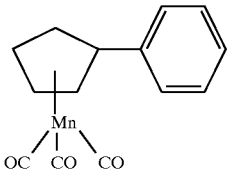
14
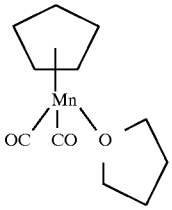
-continued
15
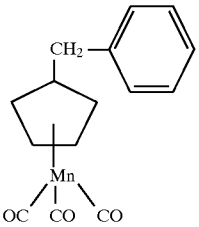
16
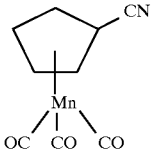
17
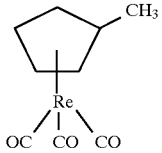
18
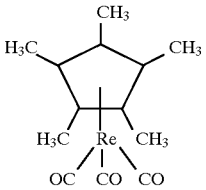
19
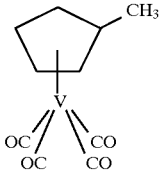
20
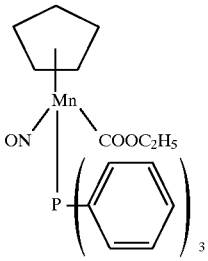
21
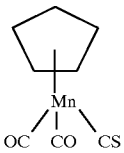
22
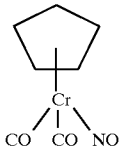

-continued
23
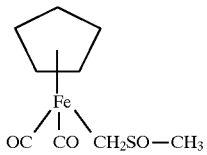
24
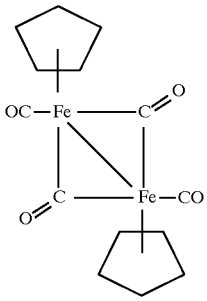
25
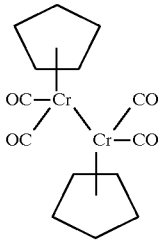
26
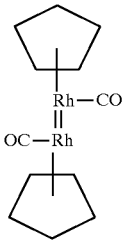
27
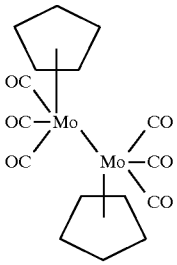
28
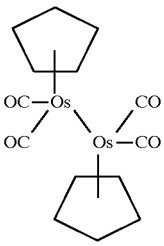
-continued
29
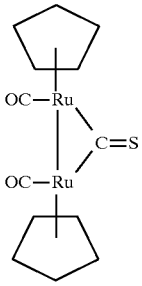
30
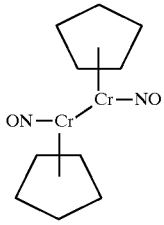
31
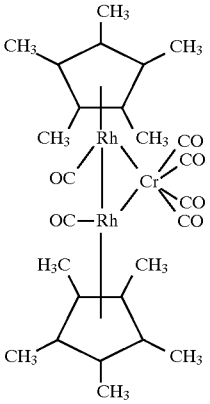
32
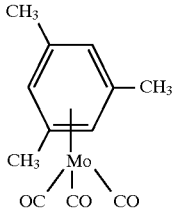
33
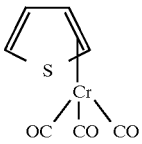
34
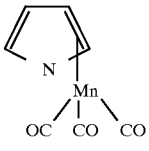
35
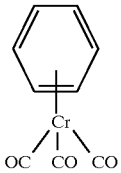

-continued

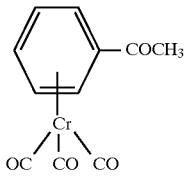

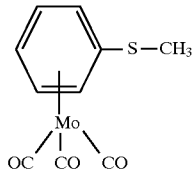

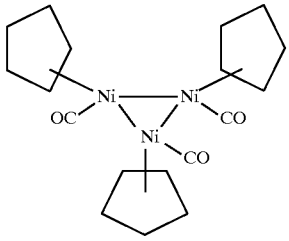

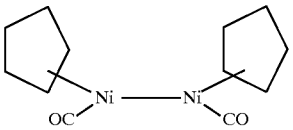

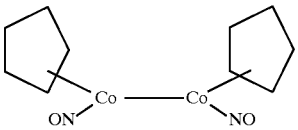

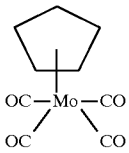

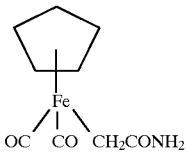

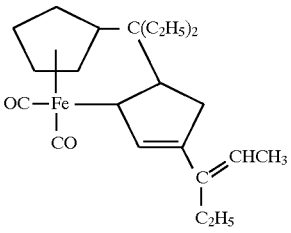

-continued

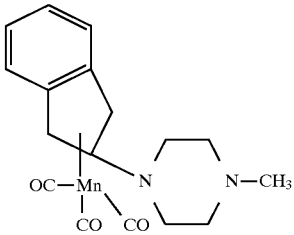

Details relating to the production and properties of the low-valent transition metal complexes usable according to the invention may in particular be found in:

1) *Angew. Chem.* 86 [1974], 651–663
2) Elscherbroich, Salzer: *Organometallchemie,* Teubner, Stuttgart 1993
3) Pauson, P. L. in Houben-Weyl; *Methoden der organischen Chemie,* volume E18, 1–450, G. Thieme, Stuttgart 1986.

Cymantrene is known from

Piper, Cotton, Wilkinson; *J. inorg. nucl Chem.* 1 (1955) 165, 175; Cotton, Leto; *Chemistry and Industry,* Oct. 18, 1958.

Cymantrene derivatives are described in

Plesske; *Angew. Chem.* 74, 301–336 (1962);
Coffield, Ihrmann; *J. Am. Chem. Soc.* 82, 1251 (1956);
Riemschneider, Kassahn; *Chem. Ber.* 92, 3208 (1959);
Riemschneider, Petzold; *Z. Naturforsch,* 15b, 627 (1960);
Kozikowski, Maginn; *J. Am. Chem. Soc.* 81, 2995 (1959);
Cais, Kozikowski; *J. Am. Chem. Soc.* 82, 5667 (1960);
Cais el al.; *Chemistry and Industry* 1960, 202.

The range of reactions possible on the cymantrene molecule is only indicated, but not limited, by the listed references. Thus, for example, the carbonyl compounds of cymantrene may be converted into the known derivatives, such as oximes, hydrazones, semicarbazones etc.

Spectral sensitising dyes which may advantageously be used in the presence of the supersensitisers according to the invention may be found in any class of conventional sensitisers, for example from the series of cyanine dyes, merocyanine dyes, rhodacyanine dyes, hemicyanine dyes, benzylidene dyes, xanthene dyes. Examples of these dyes are described in Th. James, *The Theory of the Photographic Process,* 3rd edition (Macmillan 1966), pages 198–228.

The dyes may sensitise silver halide over the entire range of the visible spectrum and also beyond into the infra-red range. Particularly preferred dyes are mono-, tri- and pentamethinecyanines of the benzoxazole, benzimidazole, benzothiazole or benzoselenazole series, which may each bear further substituents or further fused rings or ring systems on the benzene rings, with the pentamethinecyanines again being those having a methine moiety which is a constituent of a partially unsaturated ring. The dyes may be cationic, uncharged in the form of betaines or sulphobetaines, or anionic. In the presence of the supersensitising cymantrenes, the quantity of dye selected may be larger than is otherwise conventional.

The supersensitising transition metal complexes may be added to the emulsion to be sensitised together with the sensitising dyes or at a time different from the addition of the dyes, either in the form of a solution or a dispersion of solids. The quantity of cymantrene derivative may be between $10^{-6}$ and $10^{-2}$ mol per mol of silver halide.

The silver halide used may consist of silver chloride, silver bromide, silver chloride-bromide, silver bromide-iodide and silver bromide-chloride-iodide. The crystals may themselves be homogeneous or non-homogeneous in zones, and the crystals may be simple crystals or singly or multiply twinned crystals. The emulsions may consist of predominantly compact or predominantly lamellar crystals. In the case of lamellar crystals, those having an aspect ratio of above 3:1 are preferred, in particular hexagonal lamellae having an adjacent edge ratio of close to 1.

The emulsion crystals may moreover be doped with certain foreign ions, for example with multivalent transition metal cations, preferably with noble metal cations having an octahedral ligand environment, for example with ruthenium, rhodium, osmium or iridium ions, wherein the function of foreign ion doping extends substantially beyond simple lattice disruption, having as its objective the incorporation of so-called flat electron traps.

The emulsions may be mono- or polydisperse and may accordingly be produced by conventional precipitation, by single to multiple twin inlet or using the micrate recrystallisation process.

The emulsions may be chemically sensitised in a conventional manner, for example by sulphur ripening, selenium ripening, ripening with sulphur and gold(I) compounds as well as with so-called reducing ripening agents. Reduction ripening may also be performed within the depth of the crystal during precipitation of the emulsion, wherein the reduction ripened nuclei are enveloped as crystal growth continues. Reducing ripening agents which may advantageously be used are divalent tin compounds, phosphane tellurides, salts of formamidine-C-sulphinic acid and hydridoborates. Organically soluble reducing ripening agents which are rapidly and completely adsorbable onto the silver halide are preferred.

The supersensitisation of spectrally sensitised emulsions with cymantrene or cymantrene derivatives is particularly advantageous in combination with stabilisation by palladium(II) compounds.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the nature of the photographic material, these layers may be differently arranged. This is demonstrated for the most important products:

Colour photographic films such as colour negative films and colour reversal films have on the support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally arranged between the green-sensitive and blue-sensitive layers to prevent blue light from reaching the underlying layers.

Possible options for different layer arrangements and the effects thereof on photographic properties are described in *J. Inf. Rec. Mats.,* 1994, volume 22, pages 183–193.

Colour photographic paper, which is usually substantially less photosensitive than a colour photographic film, conventionally has on the support, in the sequence stated below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photo-sensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed usingi different processes depending upon their nature. Details relating, to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLE 1

A tabular silver bromide-iodide emulsion containing 9 mol. % of AgI, ripened to optimum sensitivity with tetrachloroauric acid (2 $\mu$mol per mol of $AgNO_3$), potassium thiocyanate (250 $\mu$Mol per mol of $AgNO_3$) and sodium thiosulphate (10 $\mu$mol per mol of $AgNO_3$), of an average grain diameter of 1.5 $\mu$m, corresponding to the average diameter of a circle of equal area, and having an aspect ratio of 7.5 is combined with 50 mg or 100 mg per mol of Ag of a transition metal complex (in each case 0.5 g dissolved in 100 ml of acetone) and then sensitised with 100 mg, 200 mg, 300 mg and 500 mg of a mixture of red sensitisers RS-1, RS-2 and RS-3 in a weight ratio of 3:6:1.

After the addition of a colour coupler emulsion, the sensitised emulsions are applied at the following rates onto a subbed cellulose triacetate support of a thickness of 120 $\mu$m.

| | |
|---|---|
| Cyan coupler C-1 | 0.3 g/m$^2$ |
| Tricresyl phosphate | 0.45 g/m$^2$ |
| Gelatine | 0.7 g/m$^2$ |
| Silver halide emulsion | 0.85 g of $AgNO_3$/m$^2$ |

A protective layer of the following composition was applied thereon:

| | |
|---|---|
| Hardener H-1 | 0.02 g/m$^2$ |
| Gelatine | 0.01 g/m$^2$ |

The individual specimens were exposed with daylight through a graduated grey wedge behind a blue filter and behind an orange filter and then processed using the process described in *The British Journal of Photography* 1974, page 597. Sensitivities are determined in relative DIN units by densitometric measurement in each case at density 0.2 above $D_{min}$.

The results are shown in Table 1 below:

TABLE 1

| Transition metal complex | Quantity | Quantity of sensitiser mixture | Blue sensitivity | Red sensitivity | $D_{min}$ |
|---|---|---|---|---|---|
| none | | 100 mg | 39.2 | 44.9 | 0.54 |
| | | 200 mg | 39.5 | 45.4 | 0.54 |
| | | 300 mg | 38.0 | 45.5 | 0.69 |
| | | 500 mg | 37.0 | 44.4 | 0.51 |
| Comparison 1 | 50 mg | 100 mg | 36.0 | 41.5 | 1.13 |
| | | 200 mg | 37.9 | 44.8 | 0.91 |
| | | 300 mg | 35.9 | 45.6 | 0.91 |
| | | 500 mg | 28.8 | 33.3 | 0.30 |
| | 100 mg | 100 mg | 37.6 | 42.9 | 1.20 |
| | | 200 mg | 37.6 | 45.4 | 1.17 |
| | | 300 mg | 36.0 | 44.4 | 0.86 |
| | | 500 mg | 26.8 | 32.5 | 0.36 |
| Comparison 2 | 50 mg | 100 mg | 37.7 | 42.7 | 1.69 |
| | | 200 mg | 37.8 | 45.0 | 1.62 |
| | | 300 mg | 38.5 | 45.2 | 1.13 |
| | | 500 mg | 37.4 | 45.3 | 0.91 |
| | 100 mg | 100 mg | 39.1 | 45.1 | 1.14 |
| | | 200 mg | 39.3 | 46.7 | 1.28 |
| | | 300 mg | 35.6 | 44.6 | 1.65 |
| | | 500 mg | 37.0 | 44.9 | 1.07 |
| Comparison 3 | 50 mg | 100 mg | 39.4 | 45.5 | 0.52 |
| | | 200 mg | 39.5 | 45.6 | 0.47 |
| | | 300 mg | 37.6 | 44.9 | 0.46 |
| | | 500 mg | 36.6 | 43.5 | 0.41 |
| | 100 mg | 100 mg | 39.0 | 45.3 | 0.54 |
| | | 200 mg | 39.1 | 45.4 | 0.53 |
| | | 300 mg | 36.7 | 44.2 | 0.38 |
| | | 500 mg | 36.3 | 44.0 | 0.41 |
| Compound 1 | 50 mg | 100 mg | 38.1 | 43.5 | 0.46 |
| | | 200 mg | 37.9 | 45.7 | 0.46 |
| | | 300 mg | 38.6 | 46.5 | 0.59 |
| | | 500 mg | 36.9 | 45.0 | 0.40 |
| | 100 mg | 100 mg | 38.2 | 44.0 | 0.39 |
| | | 200 mg | 39.0 | 46.5 | 0.62 |
| | | 300 mg | 38.5 | 46.4 | 0.66 |
| | | 500 mg | 37.1 | 44.7 | 0.43 |
| Compound 2 | 50 mg | 100 mg | 38.2 | 43.9 | 0.39 |
| | | 200 mg | 38.5 | 45.9 | 0.45 |
| | | 300 mg | 38.6 | 46.3 | 0.50 |
| | | 500 mg | 37.2 | 45.6 | 0.42 |
| | 100 mg | 100 mg | 38.2 | 44.0 | 0.40 |
| | | 200 mg | 38.1 | 46.5 | 0.46 |
| | | 300 mg | 38.6 | 46.3 | 0.55 |
| | | 500 mg | 38.0 | 45.0 | 0.50 |
| Compound 17 | 50 mg | 100 mg | 37.0 | 43.5 | 0.35 |
| | | 200 mg | 38.0 | 46.0 | 0.50 |
| | | 300 mg | 38.5 | 46.2 | 0.59 |
| | | 500 mg | 36.9 | 45.0 | 0.48 |
| | 100 mg | 100 mg | 38.2 | 43.9 | 0.36 |
| | | 200 mg | 38.0 | 46.8 | 0.48 |
| | | 300 mg | 36.0 | 45.9 | 0.55 |
| | | 500 mg | 37.9 | 44.0 | 0.45 |
| Compound 19 | 50 mg | 100 mg | 37.5 | 43.9 | 0.30 |
| | | 200 mg | 37.8 | 45.9 | 0.55 |
| | | 300 mg | 38.3 | 45.8 | 0.60 |
| | | 500 mg | 37.3 | 45.0 | 0.50 |
| | 100 mg | 100 mg | 37.6 | 44.2 | 0.42 |
| | | 200 mg | 37.9 | 45.8 | 0.55 |
| | | 300 mg | 38.1 | 45.7 | 0.59 |
| | | 500 mg | 37.1 | 43.1 | 0.47 |
| Compound 22 | 50 mg | 100 mg | 36.0 | 44.1 | 0.39 |
| | | 200 mg | 38.0 | 45.9 | 0.45 |
| | | 300 mg | 38.1 | 45.8 | 0.60 |
| | | 500 mg | 35.6 | 44.0 | 0.53 |
| | 100 mg | 100 mg | 35.0 | 44.0 | 0.40 |
| | | 200 mg | 37.1 | 46.5 | 0.63 |
| | | 300 mg | 37.3 | 46.4 | 0.65 |
| | | 500 mg | 37.0 | 43.0 | 0.51 |

Comparison 1 is cyclopentadienyliron dicarbonyl iodide.
Comparison 2 is diindenyliron.
Comparison 3 is ferrocene (biscyclopentadienyliron).
Cyan coupler C-1 is of the formula

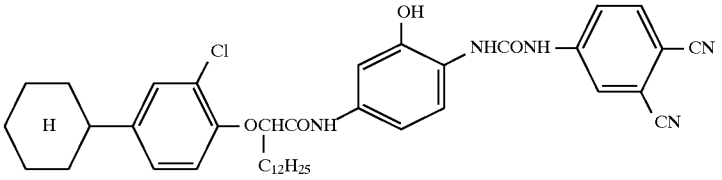

Hardener H-1 is of the formula

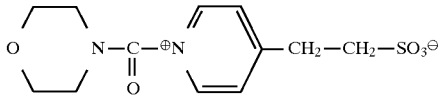

The sensitisers are of the formula

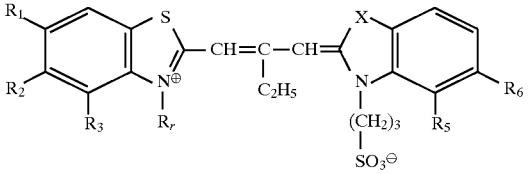

RS-1: $R_1$, $R_2$=$CH_3R_3$, $R_5$=H; $R_4$=$(CH_2)_3SO_3Na$; $R_6$=phenyl; X=O;

RS-2: $R_1$, $R_3$, $R_5$=H; $R_2$, $R_6$=Cl; $R_4$=$C_2H_5$; X=S;

RS-3: $R_1$=H; $R_2$ and $R_3$ together and $R_5$ and $R_6$ together each mean —CH=CH—CH=CH—; $R_4$=$(CH_2)_3SO_3Na$; X=S.

EXAMPLE 2

A tabular silver bromide-iodide emulsion containing 3.2 mol. % of AgI, ripened to optimum sensitivity with tetrachloroauric acid (20 μmol per mol of $AgNO_3$), ammonium thiocyanate (250 μmol per mol of $AgNO_3$) and sodium thiosulphate (20 μmol per mol of $AgNO_3$), of an average grain diameter of 0.45 μm, corresponding to the average diameter of a circle of equal area, and having an aspect ratio of 4.5 is combined with 100 mg per mol of Ag of a transition metal complex (in each case 0.5 g dissolved in 100 ml of acetone) and then sensitised with 100 mg, 200 mg, 300 mg and 500 mg of a mixture of red sensitisers RS-1, RS-2 and RS-3 in a weight ratio of 3:6:1.

After the addition of a colour coupler emulsion, the sensitised emulsions are applied at the following rates onto a subbed cellulose triacetate support of a thickness of 120 μm.

| | |
|---|---|
| Cyan coupler C-1 | 0.3 g/m$^2$ |
| Tricresyl phosphate | 0.45 g/m$^2$ |
| Gelatine | 0.7 g/m$^2$ |
| Emulsion | 0.85 g of $AgNO_3$/m$^2$ |

A protective layer of the following composition was applied thereon:

| | |
|---|---|
| Hardener H-1 | 0.02 g/m$^2$ |
| Gelatine | 0.01 g/m$^2$ |

The individual specimens were processed and assessed as in Example 1.

The results are shown in Table 2 below:

TABLE 2

| Transition metal complex | Quantity | Quantity of sensitiser mixture | Blue sensitivity | Red sensitivity | $D_{min}$ |
|---|---|---|---|---|---|
| none | | 100 mg | 30.1 | 34.8 | 0.34 |
| | | 200 mg | 30.5 | 35.5 | 0.32 |
| | | 300 mg | 29.6 | 35.7 | 0.35 |
| | | 500 mg | 27.0 | 34.3 | 0.31 |
| Comparison 3 | 100 mg | 100 mg | 31.6 | 32.5 | 1.13 |
| | | 200 mg | 28.5 | 33.3 | 0.36 |
| | | 300 mg | 29.0 | 33.5 | 0.36 |
| | | 500 mg | 26.0 | 32.0 | 0.37 |
| Compound 1 | 100 mg | 100 mg | 28.0 | 35.6 | 0.29 |
| | | 200 mg | 28.8 | 36.4 | 0.31 |
| | | 300 mg | 28.8 | 36.8 | 0.38 |
| | | 500 mg | 27.1 | 35.2 | 0.31 |
| Compound 2 | 100 mg | 100 mg | 28.3 | 35.4 | 0.35 |
| | | 200 mg | 29.0 | 36.8 | 0.35 |
| | | 300 mg | 29.2 | 36.9 | 0.45 |
| | | 500 mg | 28.5 | 35.9 | 0.42 |
| Compound 23 | 100 mg | 100 mg | 29.1 | 34.0 | 0.33 |
| | | 200 mg | 29.0 | 36.1 | 0.34 |
| | | 300 mg | 28.8 | 35.9 | 0.40 |
| | | 500 mg | 28.5 | 32.2 | 0.25 |
| Compound 26 | 100 mg | 100 mg | 29.0 | 34.3 | 0.30 |
| | | 200 mg | 30.0 | 36.3 | 0.41 |
| | | 300 mg | 30.2 | 35.5 | 0.48 |
| | | 500 mg | 25.0 | 28.2 | 0.75 |
| Compound 34 | 100 mg | 100 mg | 28.9 | 33.0 | 0.40 |
| | | 200 mg | 29.3 | 36.6 | 0.45 |
| | | 300 mg | 29.7 | 35.5 | 0.41 |
| | | 500 mg | 28.3 | 30.0 | 0.60 |

EXAMPLE 3

A cubic silver chloride-bromide emulsion (80 mol. % chloride, 20 mol. % bromide) having crystals of an edge length of 0.4 μm was produced by twin inflow, desalted by precipitation with polystyrenesulphonic acid and washing, redispersed at pH 5.8, ripened to optimum sensitivity with potassium thiocyanate, tetrachloroauric acid and sodium thiosulphate and spectrally sensitised with the red sensitiser combination stated in Example 1 (250 μmol per mol of Ag).

The emulsion was divided into 6 portions. The following additions were made to the individual specimens in the form of a 0.5 wt. % solution in acetone.

Emulsion 1: No addition

Emulsion 2: 100 μmol of Comparison 3 per mol of Ag

Emulsion 3: 100 μmol of Comparison 2 per mol of Ag

Emulsion 4: 100 μmol of Compound 2 per mol of Ag

Emulsion 5: 100 μmol of Compound 21 per mol of Ag

Emulsion 6: 100 μmol of Compound 18 per mol of Ag

The specimens of emulsions 1 to 6 were each combined with an emulsion of the yellow coupler (GB-1) in tricresyl phosphate and applied onto a film support of paper coated on both sides with polyethylene.

The individual cast layers have the following contents per m$^2$:

0.63 g of $AgNO_3$ 1.38 g of gelatine 0.95 g of GB-1

0.29 g of tricresyl phosphate

The material is hardened by applying a protective layer of 0.2 g of gelatine and 0.3 g of hardener H-1 per $m^2$. Specimens of the material are exposed with an image through a graduated wedge and processed using the Ektacolor RA-4 process.

The sensitometric results are shown in Table 3:

TABLE 3

| Emulsion | $D_{min}$ | log I − t | γ1 | γ2 |
|---|---|---|---|---|
| 1 | 0.107 | 1.708 | 1.67 | 3.69 |
| 2 | 0.114 | 1.800 | 1.48 | 3.40 |
| 3 | 0.235 | 2.278 | 1.49 | 3.30 |
| 4 | 0.112 | 2.363 | 1.56 | 3.65 |
| 5 | 0.121 | 2.388 | 1.60 | 3.62 |
| 6 | 0.125 | 2.350 | 1.58 | 3.55 |

Further specimens were stored unexposed for 1 month and then subjected to processing using the Ektacolor RA-4 process.

The results are shown in Table 4:

TABLE 4

| Emulsion | $D_{min}$ | log I − t | γ1 | γ2 |
|---|---|---|---|---|
| 1 | 0.127 | 1.600 | 1.57 | 3.00 |
| 2 | 0.120 | 1.600 | 1.28 | 3.04 |
| 3 | 0.333 | 2.002 | 1.19 | 3.03 |
| 4 | 0.135 | 2.276 | 1.45 | 3.55 |
| 5 | 0.148 | 2.288 | 1.46 | 3.54 |
| 6 | 0.149 | 2.300 | 1.48 | 3.47 |

The results shows that lower sensitivity losses and less flattening of gradation are observed in the emulsions 4 to 6 according to the invention.

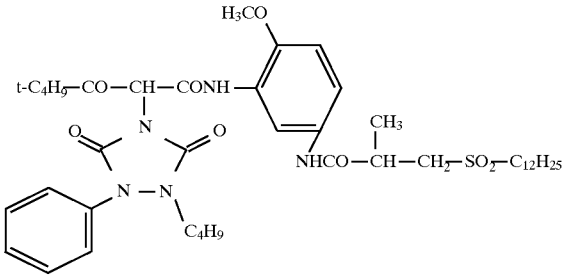

We claim:

1. A spectrally sensitized photographic silver halide emulsions which comprises a photographic silver halide emulsion which is supersensitized with an aromatic complex having a central transition metal atom which is present in a valence state which is not the highest possible for the metal concerned and which complex contains at least one non-aromatic complex ligand.

2. The silver halide emulsion according to claim 1, wherein the photographic emulsion is supersentized with a cyclopentadienemanganese (II) tricarbonyl.

3. The silver halide emulsion according to claim 1, wherein the photographic emulsion is supersentized with a mononuclear cyclopentadienemanganese carbonyl complex in a quantity of $10^{-6}$ to $10^{-2}$ mol/mol of silver halide.

4. A color photographic silver halide material which comprises a support and at least one photosensitive silver halide emulsion layer, said silver halide emulsion layer contains the spectrally sensitized photographic silver halide emulsion according to claim 1.

5. The silver halide emulsion according to claim 1, wherein said transitional metal atom is selected from the group consisting of vanadium, chromium, manganese, iron, cobalt, nickel, molybdenum, rhenium, rhodium, tungsten, osmium and iridium.

6. The silver halide emulsion according to claim 1, wherein said non-aromatic complex ligand is CO, R—N═C or NO wherein R is alkyl or aryl.

7. The silver halide emulsion according to claim 5, wherein the non-aromatic complex ligand is CO.

8. The silver halide emulsion according to claim 1, wherein said aromatic complex is selected from the group consisting of

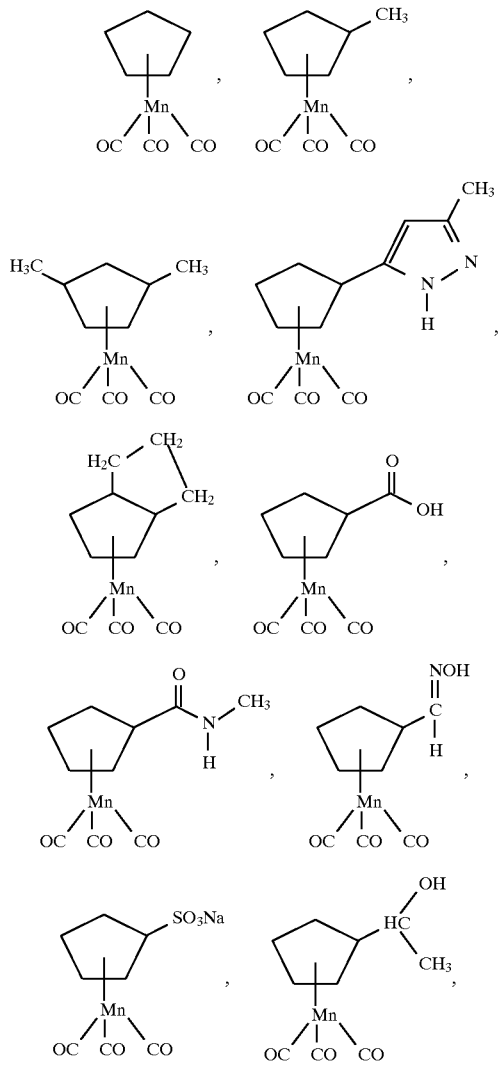

-continued
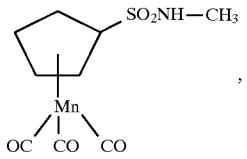
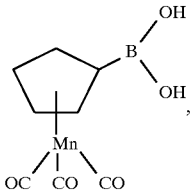
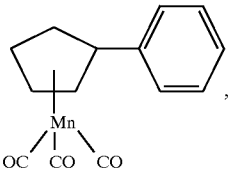
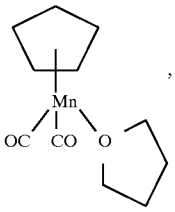
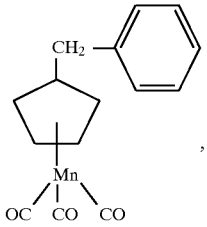
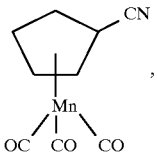
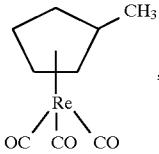
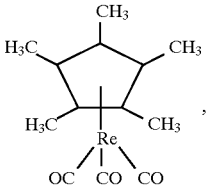
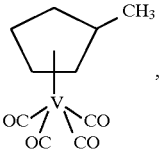
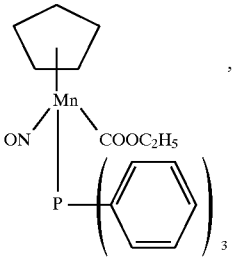
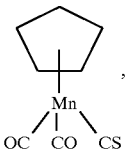
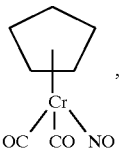
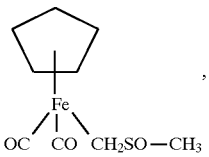
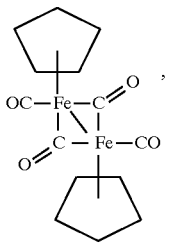
-continued
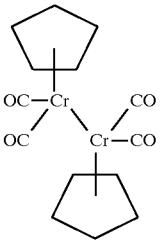
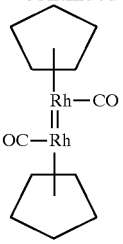
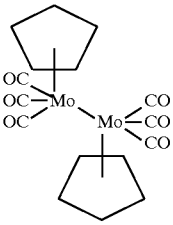
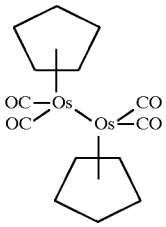
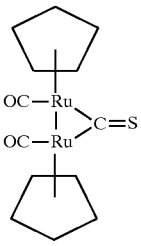
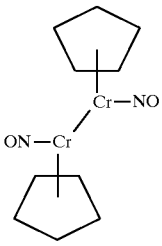
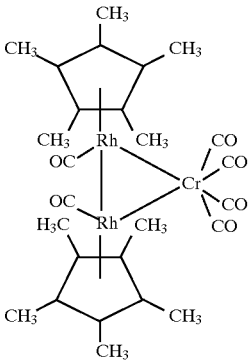
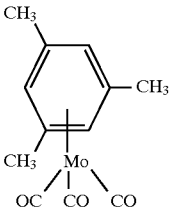
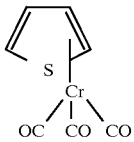
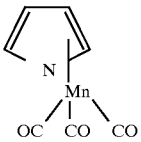
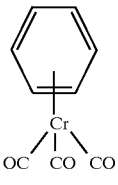
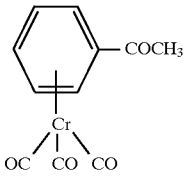
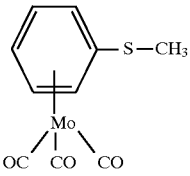
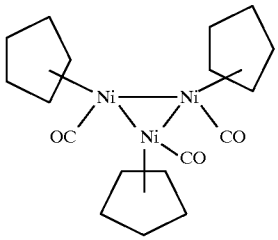
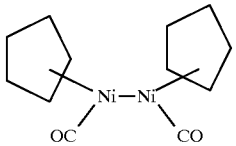
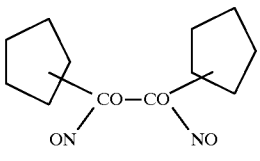

-continued
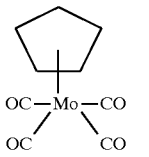
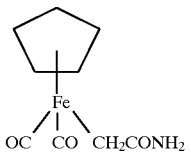
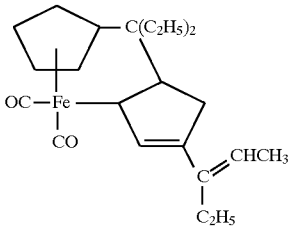
and
-continued
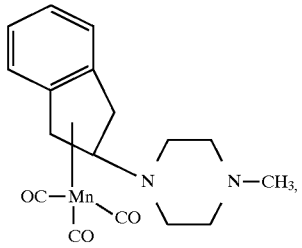
* * * * *